US006230786B1

(12) United States Patent
Choshi

(10) Patent No.: US 6,230,786 B1
(45) Date of Patent: May 15, 2001

(54) AUTOMATIC MOLTEN METAL SUPPLY AND INJECTION DEVICE

(75) Inventor: Yukihisa Choshi, Izumi (JP)

(73) Assignee: Shin-Ei Die Casting Ind. Co., Ltd., Osaka (JP); a part interest ( * ) Notice: Subject to any disclaimer, the term of this patent is extended or adjusted under 35 U.S.C. 154(b) by 0 days.

(21) Appl. No.: 09/317,205

(22) Filed: May 24, 1999

(30) Foreign Application Priority Data

May 26, 1998 (JP) ..... 10-144403

(51) Int. Cl.[7] ..... B22D 17/04

(52) U.S. Cl. ..... 164/312; 164/314; 164/337; 425/557

(58) Field of Search ..... 164/312, 337, 164/314, 113, 133, 136; 425/557, 558

(56) References Cited

U.S. PATENT DOCUMENTS 5,205,338 * 4/1993 Shimmell ..... 164/312
5,244,033 * 9/1993 Ueno ..... 164/312
5,698,242 * 12/1997 Chen et al. ..... 425/544
5,735,333 * 4/1998 Nagawa ..... 164/312

FOREIGN PATENT DOCUMENTS 49-28087 * 7/1974 (JP) ..... 164/312

* cited by examiner

*Primary Examiner*—Harold Pyon
*Assistant Examiner*—I.-H. Lin
(74) *Attorney, Agent, or Firm*—Wenderoth, Lind & Ponack, L.L.P.

(57) ABSTRACT

An automatic molten metal supply and injection device which can prevent mixing of air into molten metal being supplied, which can reduce the possibility of explosion and the development of pores, and which makes it possible to supply molten metal irrespective of whether the molds are open or closed. The device includes a body for guiding molten metal, a sleeve having a suction port and a discharge port for opening and closing communication between a molten metal passage of the body and the suction port, a first piston axially movably mounted in the sleeve for sucking molten metal in the sleeve into a predetermined amount through the suction port and extruding the thus sucked molten metal through the discharge port, and a second piston axially movably mounted in the first piston for opening and closing the discharge port and for pressurizing molten metal being discharged through the discharge port. The first and second pistons are movable independently of each other. Thus, it is possible to prevent mixing of air into molten metal being supplied into the molds.

6 Claims, 9 Drawing Sheets

PRIOR ART FIG. 8A
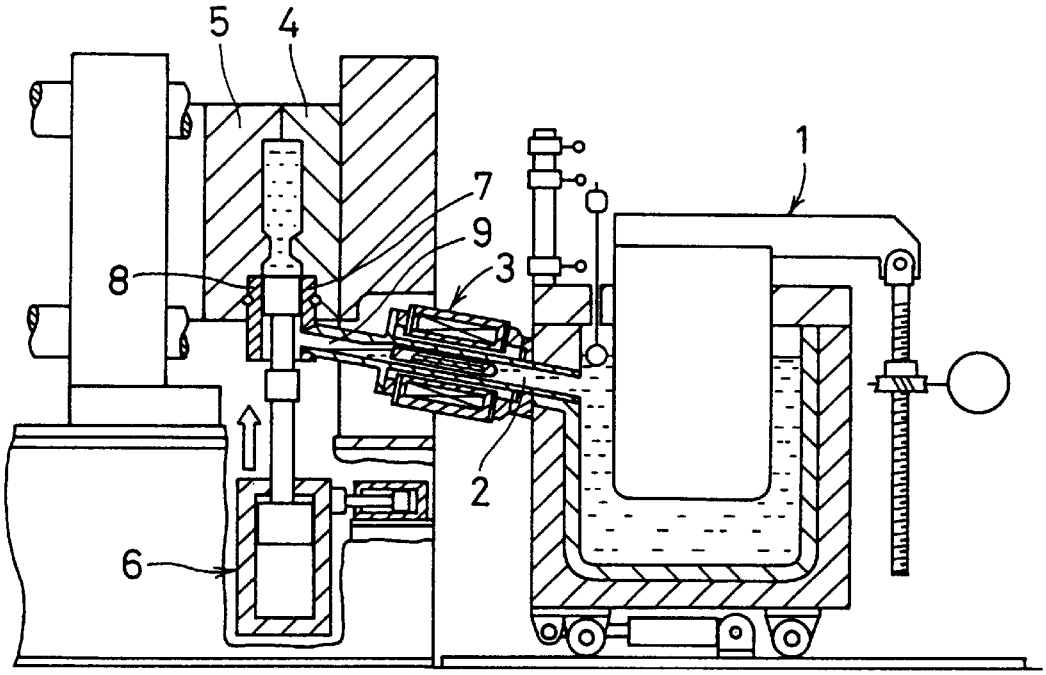
PRIOR ART FIG. 8B
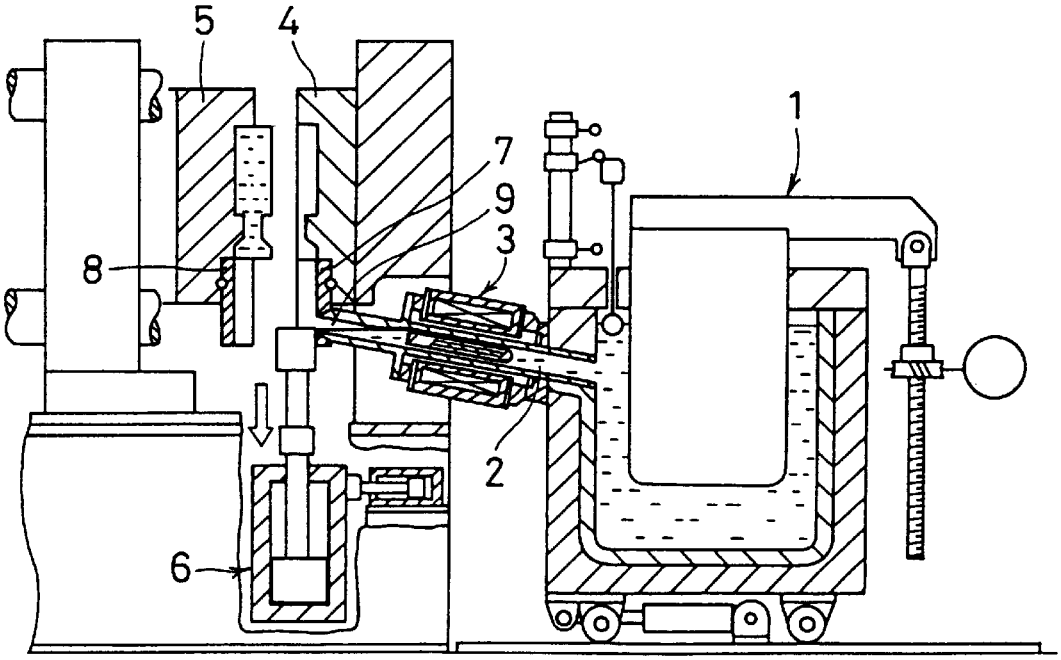

AUTOMATIC MOLTEN METAL SUPPLY AND INJECTION DEVICE

BACKGROUND OF THE INVENTION

This invention relates to an automatic molten metal supply and injection device used for casting molten metal into a metallic mold or a mold for sand mold casting or for casting semihardened molten metal into a mold.

Automatic molten metal supply devices and injectors for casting molten metal into a mold are available in various types and structures. FIGS. 7 to 9 show conventional automatic molten metal supply devices and injectors of different types.

The automatic molten metal supply device and injector shown in FIGS. 7A–8B includes a molten metal retaining furnace 1 having an outlet 2 to which is connected to the suction side of an electromagnetic pump 3. In the furnace, the level of molten metal is kept constant. An upright injection cylinder 6 is provided under a pair of openable molds 4, 5. Split sleeves 7 and 8 are fixed to the bottom ends of the molds 4 and 5, respectively. The discharge port of the electromagnetic pump 3 is connected to the sleeve 7 of the stationary mold 4.

The molds 4, 5, which are initially open as shown in FIG. 7A, are closed as shown in FIG. 7B, and the electromagnetic pump 3 is activated to supply a required amount of molten metal from the furnace 1 into the now closed sleeves 7, 8. Then, as shown in FIG. 8A, the cylinder 6 is extended to supply molten metal from the sleeves 7, 8 into a cavity of the molds 4, 5 under pressure.

The cylinder 6 is then retracted as shown in FIG. 8B, and the molds 4 and 5 are opened,to remove the molded product.

The automatic molten metal supply device and injector shown in FIGS. 9A–9C includes a pair of openable molds 11 and 12. A horizontal sleeve 14 communicating with the cavity 13 is fixed to one of the molds 11 and 12. The sleeve 14 has a molten metal supply port at one end thereof. An injection plunger 16 is inserted in the sleeve 14.

With this automatic molten metal supply device and injector, with the molds 11, 12 closed, molten metal in the container 17 is poured through a molten metal supply port 15 into the sleeve 14 and supplied into the cavity 13 of the molds 11, 12 under the pressure by the plunger 16. The plunger 16 is then retracted, and the molds 11, 12 are opened to remove the product.

These devices have a problem in that while molten metal is being supplied into the sleeve, an air layer tends to appear in the cavity, so that air tends to mix into the molten metal. This increases the possibility of pores being developed in the end product. Also, if a magnesium alloy is cast, air mixed into the molten magnesium alloy can cause explosion.

Also, in these conventional devices, molten metal can be supplied only after the molds have been closed. Working efficiency is thus low.

An object of this invention is to provide an integrated automatic molten metal supply and injection device which can prevent mixing of air into molten metal being supplied, which can reduce the possibility of explosion and the development of pores, and which makes it possible to supply molten metal irrespective of whether the molds are open or closed.

SUMMARY OF THE INVENTION

According to this invention, there is provided an automatic molten metal supply and injection device comprising a body having a molten metal passage for guiding molten metal, a sleeve having a molten metal suction port and a discharge port and adapted to be rotated for opening and closing communication between a molten metal passage of the body and the suction port, a first piston axially movably mounted in the sleeve for sucking molten metal into the sleeve by a predetermined amount through the suction port and extruding the thus sucked molten metal through the discharge port, and a second piston axially movably mounted in the first piston to extend therethrough for opening and closing the discharge port and pressurizing the molten metal through the discharge port, the first and second pistons being movable independently of each other.

Other features and objects of the present invention will become apparent from the following description made with reference to the accompanying drawings, in which:

BACKGROUND OF THE INVENTION

FIGS. 8A and 8B are additional views of the conventional device; and

DETAILED DESCRIPTION OF THE PREFERRED EMBODIMENT

Figure 1:
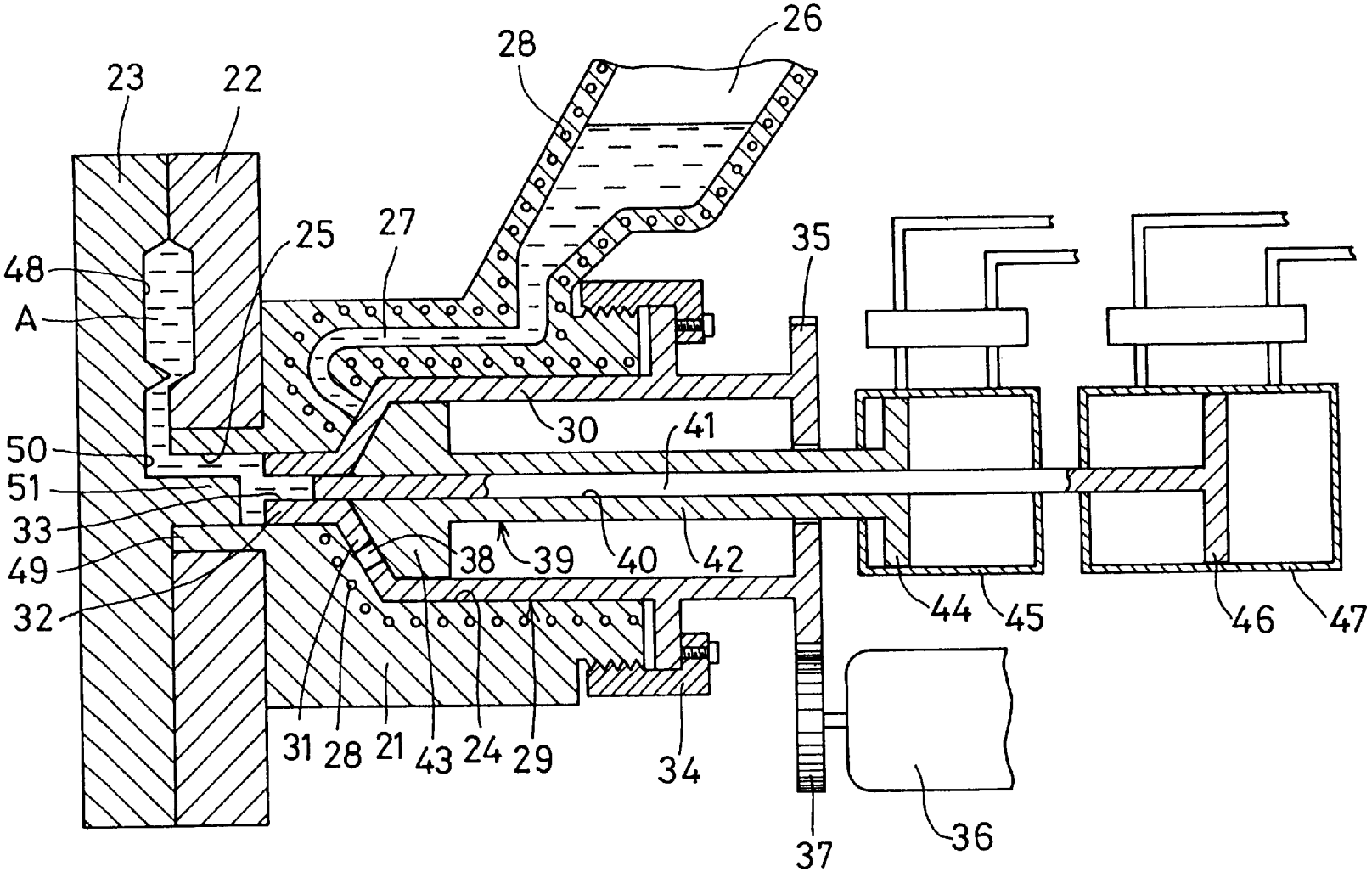
FIG. 1 is a vertical sectional view of an automatic molten metal supply and injection device embodying the present invention showing a state when casting has been completed.

An embodiment of this invention is described with reference to FIGS. 1 to 6.

As shown, an automatic molten metal supply and injection device has a body 21 for guiding molten metal, and a pair of molds 22 and 23. At its front end, the body 21 is fixed to the stationary mold 22. The body 21 has a horizontal circular hole 24 having a conical inner end and opening at a rear end thereof, a discharge port 25 provided at the front end so as to be coaxial and communicating with the circular hole 24, a molten metal passage 27 communicating at one end with a metal melting portion 26 and at the other end with the inner conical portion of the circular hole 24, a heater 28 for heating the passage 27 and the body 21, and another heater 28 provided in the metal melting portion 26 for heating metal.

A sleeve 29 is rotatably inserted in the circular hole 24 of the body 21. The sleeve has a cylindrical portion 30 with a tapered portion 31 provided at its front end so that it has an outer shape complementary to the circular hole 24. At the tip of the tapered portion 31, a tubular portion 32 is provided and inserted in the discharge port 25. The interior of the tubular portion 32 forms a discharge port 33 of the sleeve 29.

The sleeve 29 has a portion protruding from the rear end of the body 21 and rotatably held by a cover 34 threaded onto the body 21. A gear 35 provided at the rear end of the sleeve 29 meshes with a gear 37 of a motor 36 to rotate the sleeve 29. A suction port 38 is formed in the tapered portion 31 of the sleeve so as to communicate with the passage 27 of the body 21. Communication therebetween can be opened and closed by rotating the sleeve 29.

Mounted in the sleeve 29 are a metering first piston 39 mounted so as to be axially slidable in the cylindrical portion 30 of the sleeve 29 for sucking a predetermined amount of molten metal into the sleeve 29 through the suction port 38 and extruding the sucked molten metal through the discharge port 33, and a pressurizing second piston 41 axially slidable in an axial through hole 40 in the first piston 39 and adapted to be pushed into and out of the discharge port 33 for opening and closing the discharge port 33 and pressurizing molten metal from the discharge port. Thus, the sleeve 29, first piston 39, second piston 41 and discharge ports 25, 33 are all arranged horizontally and coaxially with one another.

The first piston 39 has a tubular portion 42 having at its front end a tapered head 43 received in the cylindrical portion 30 of the sleeve 29 and at its rear end a piston 44 protruding from the rear end of the sleeve 29 and received in a first hydraulic cylinder 45. The second piston 41 is a shaft received in the through hole 40 of the first piston 39 and has at its rear end a piston 46 protruding from the rear end of the first cylinder 45 and received in a second hydraulic cylinder 47. The first piston 39 and the second piston 41 can thus be moved axially independently of each other by the first hydraulic cylinder 45 and the second hydraulic cylinder 47, respectively.

A cavity 48 is defined between the pair of openable molds 22 and 23. A tubular portion 49 at the front end of the body 21 is fixedly fitted in the fixed mold 22. The movable mold 23 has a protrusion 51 adapted to be inserted into the discharge port 25 while the molds 22 and 23 are closed to define between the molds a molten metal passage 50 communicating with the cavity 48.

A molten metal used for casting may be an aluminum alloy, zinc alloy, magnesium alloy, or any other metal or alloy that can be used for squeeze casting, diecast casting, gravity casting, sand mold casting or low-pressure mold casting.

In the embodiment, the sleeve 29 and the first and second pistons 39, 41 are arranged horizontally, but they may be arranged to extend obliquely, or for low-pressure mold casting, they may be arranged even vertically. In the vertical arrangement, the metal melting portion 26 is preferably bent upwardly at its intermediate portion to prevent entry of air into the molten metal flowing toward the molten metal passage 27.

The operation of the automatic molten metal supply and injection device will be described below.

FIG. 1 shows a state when casting has been completed. That is, a product A has been cast in the cavity 48 of the closed molds 22 and 23. The suction port 38 of the sleeve 29 is not communicating with the passage 27 of the body 21. The first piston 39 is in its advanced position, closing the suction port 38. The second piston 41 is also in its advanced position with its front end inserted in the tubular portion 32, closing the discharge port 33.

Figure 2:
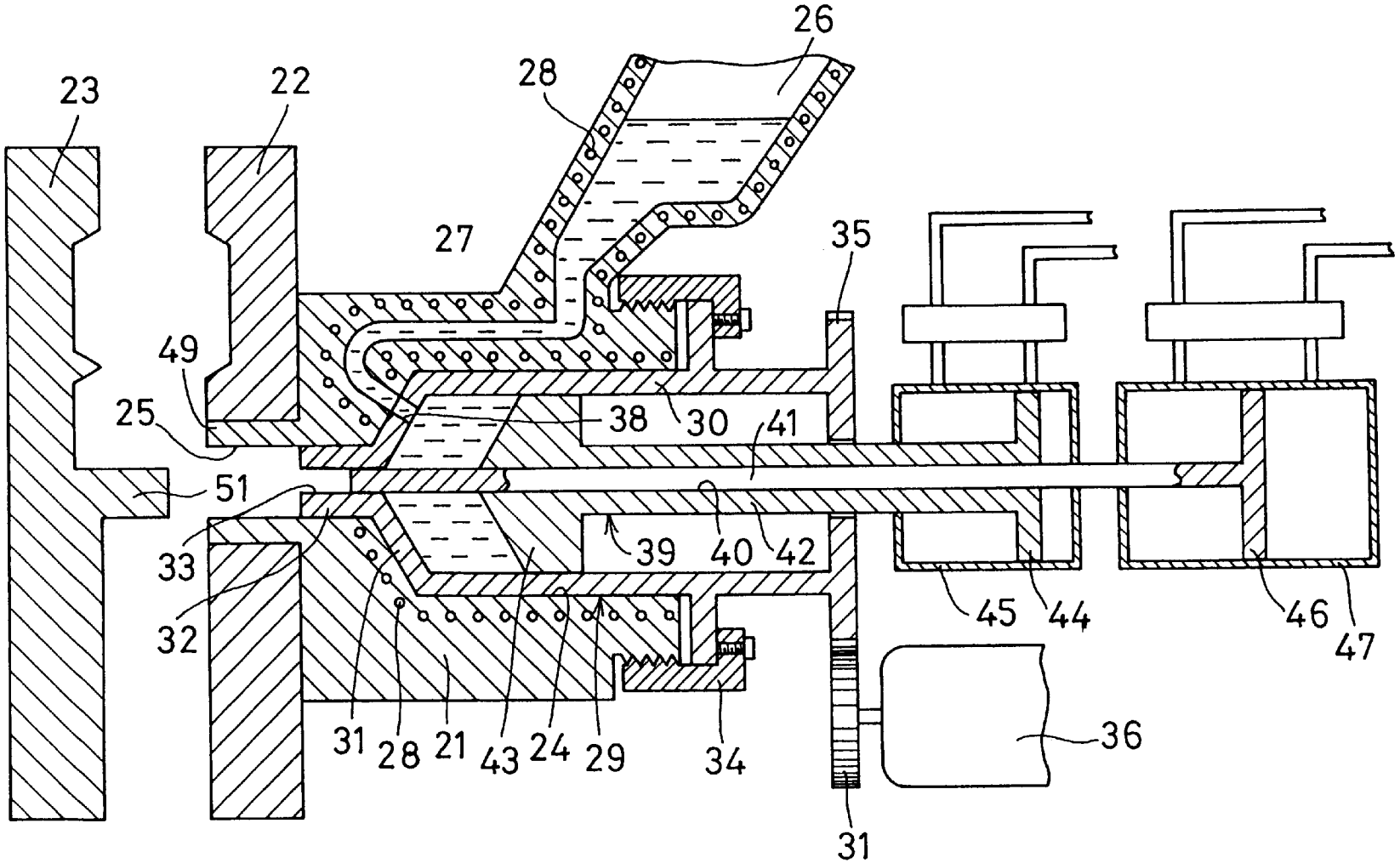
FIG. 2 is a similar view of the same showing a state in which the molds are open.

FIG. 2 shows a state when the product has been released by opening the molds 22 and 23. The sleeve 29 is rotated by a predetermined angle by the motor 36 to communicate the suction port 38 with the passage 27. Then, the first piston 39 is retracted by a predetermined stroke by the first hydraulic cylinder 45 to suck a predetermined amount of molten metal into the sleeve 29 at its front portion through the suction port 38 under the suction force produced in the sleeve 29 by closing the discharge port 33 with the second piston 41. Also, the molds 22, 23 are opened, the product A is removed, and a releasing agent is applied to the inner wall of the molds 22, 23. When a predetermined amount of molten metal has been held in the sleeve 29, the first piston 39 is stopped, and the sleeve 29 is rotated by a predetermined angle by the motor 36 to close communication between the suction port 38 and the passage 27.

Figure 3:
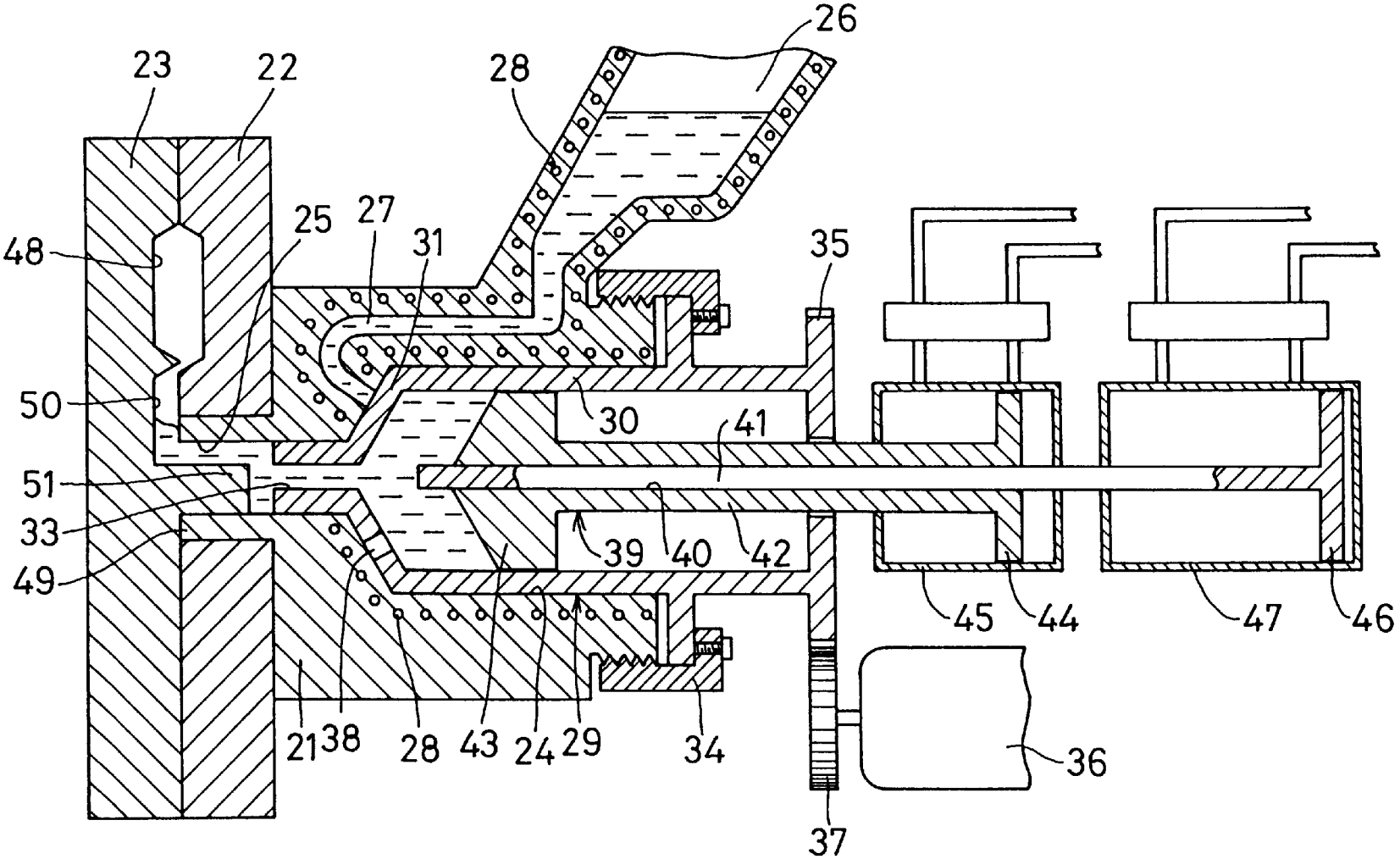
FIG. 3 is a similar view of the same showing a state when a predetermined amount of molten metal has been sucked into the device.

FIG. 3 shows a state after the molds 22, 23 have been closed. With a predetermined amount of molten metal held in the sleeve 29, the motor 36 is activated to turn the sleeve 29 by a predetermined angle, thereby closing communication between the suction port 38 and the passage 27. With the molds 22, 23 closed, the second piston 41 is retracted by a predetermined stroke by the second hydraulic cylinder 47 to open the discharge port 33 of the sleeve 29, thereby establishing communication between the interior of the sleeve 29 and the cavity 48 of the molds 22, 23 through the discharge ports 25, 33 and the passage 50. After the second piston 41 has been retracted, the first hydraulic cylinder 45 is activated to move the first piston 39 forward.

Figure 4:
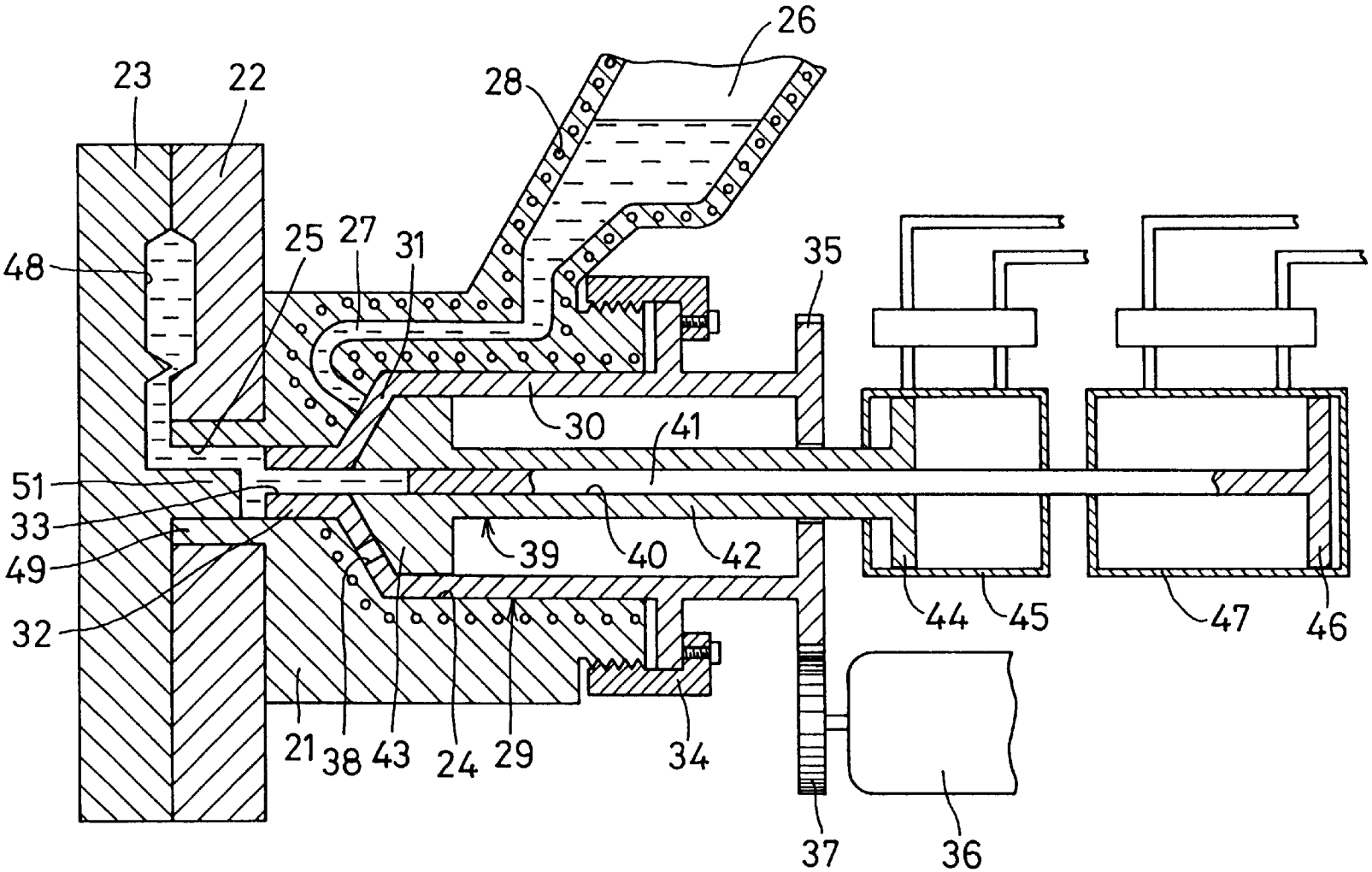
FIG. 4 is a similar view of the same showing a state when molten metal has been poured into the cavity of the molds.

FIG. 4 shows a state in which molten metal has been poured into the cavity 48 of the molds 22, 23. With the second piston 41 at a standstill, the first piston 39 is moved to its advanced position to extrude molten metal in the sleeve 29. The molten metal extruded is poured into the cavity 48. Since molten metal in the sleeve 29 is extruded in a predetermined amount by the first piston 39, the molten metal poured into the cavity 48 is not pressurized.

Figure 5:
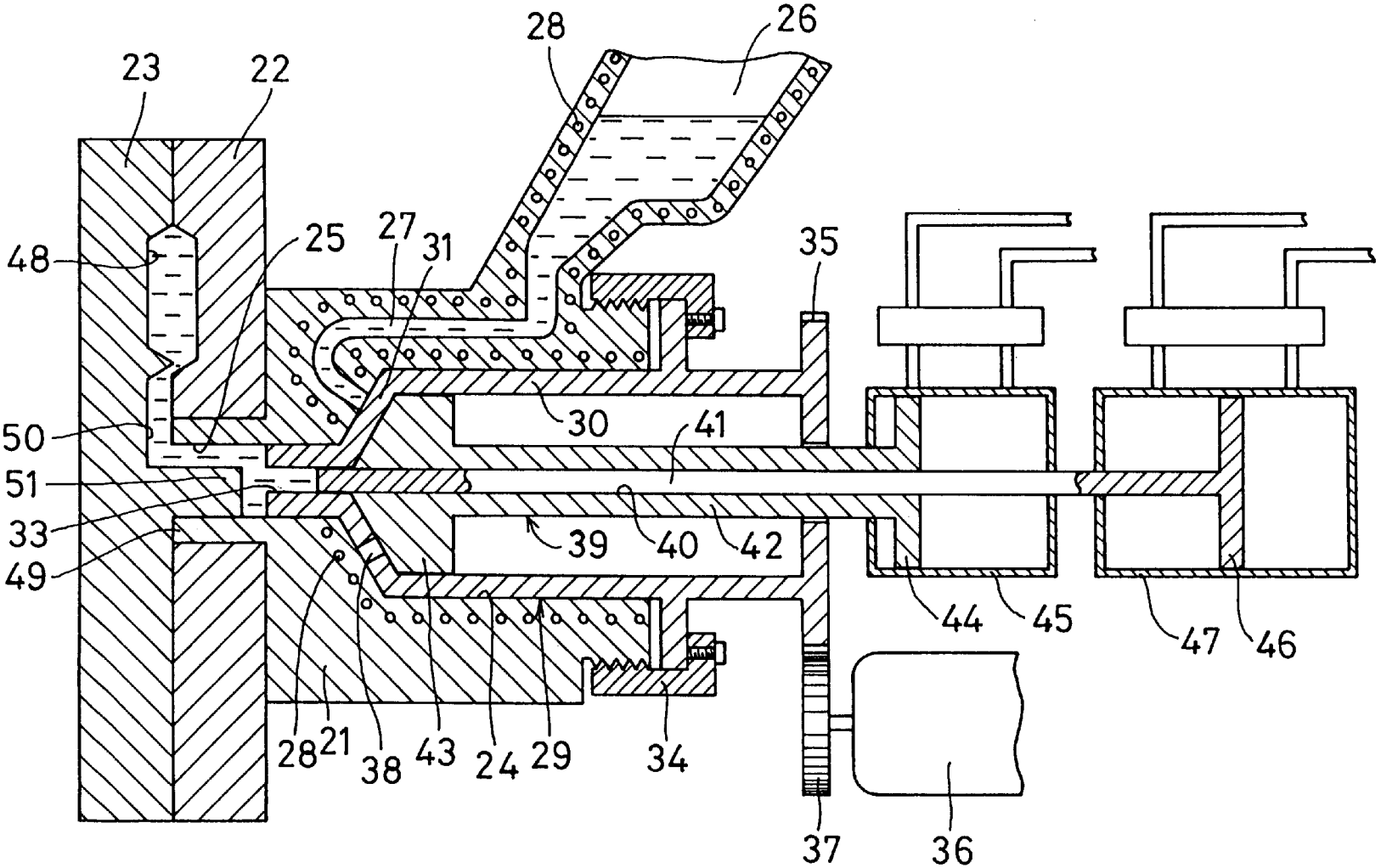
FIG. 5 is a similar view of the same showing a state when molten metal in the cavity is pressurized.

In the state of FIG. 4, when the second piston 41 advances, its front end is inserted into the discharge port 33 of the sleeve 29 as shown in FIG. 5, thereby pressurizing the molten metal in the cavity 48. This completes the casting.

Since the sleeve 29 and the first and second pistons 39 and 41 are arranged along a common horizontal axis, no air will mix in the molten metal passage from the metal melting portion 26 to the molds 22, 23 while molten metal is being poured into the cavity 48 of the molds 22, 23, so that it is possible to prevent the entry of air into the molten metal.

Figure 6:
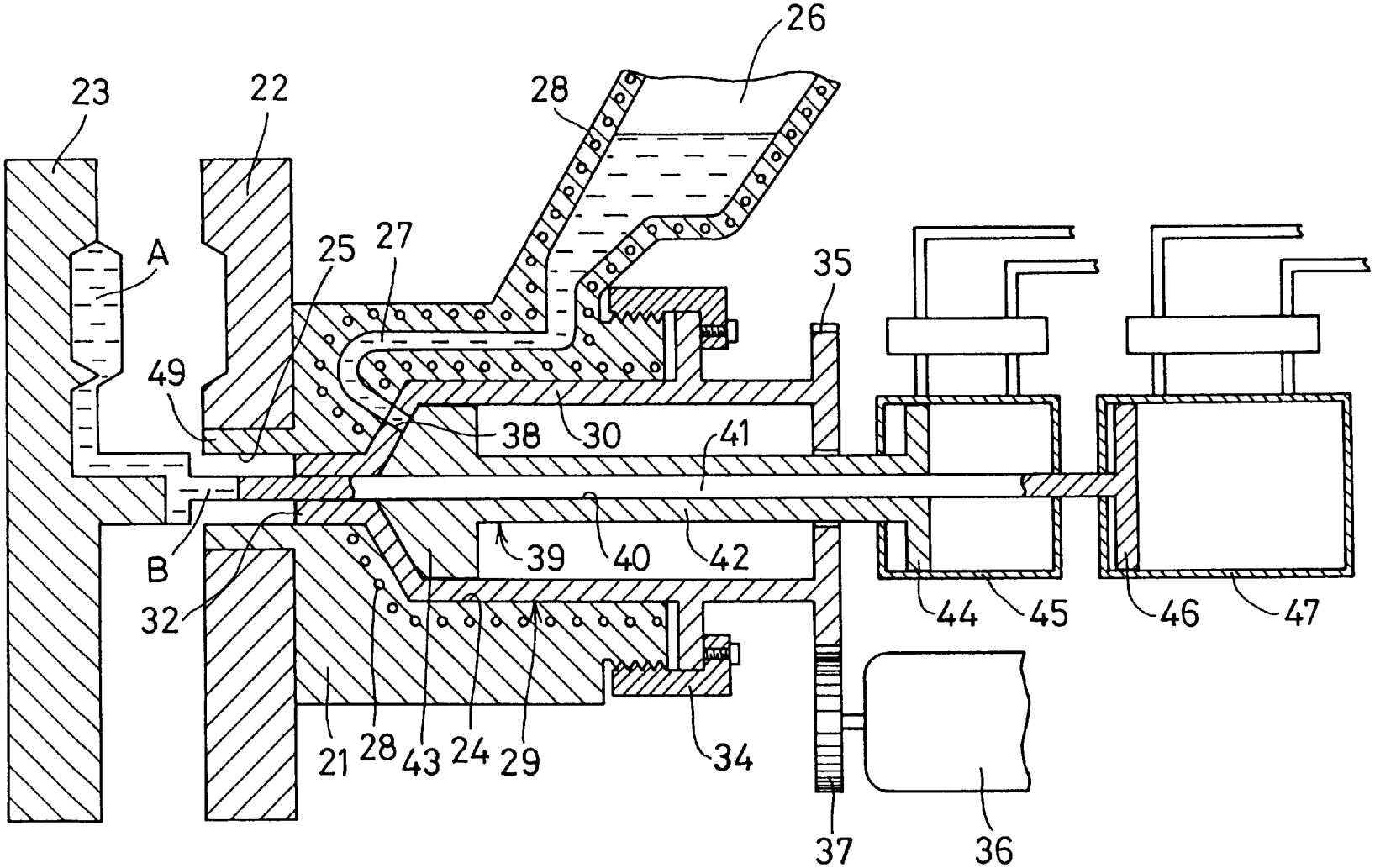
FIG. 6 is a similar view of the same showing a state when a product has been removed by opening the molds.
Figure 7A:
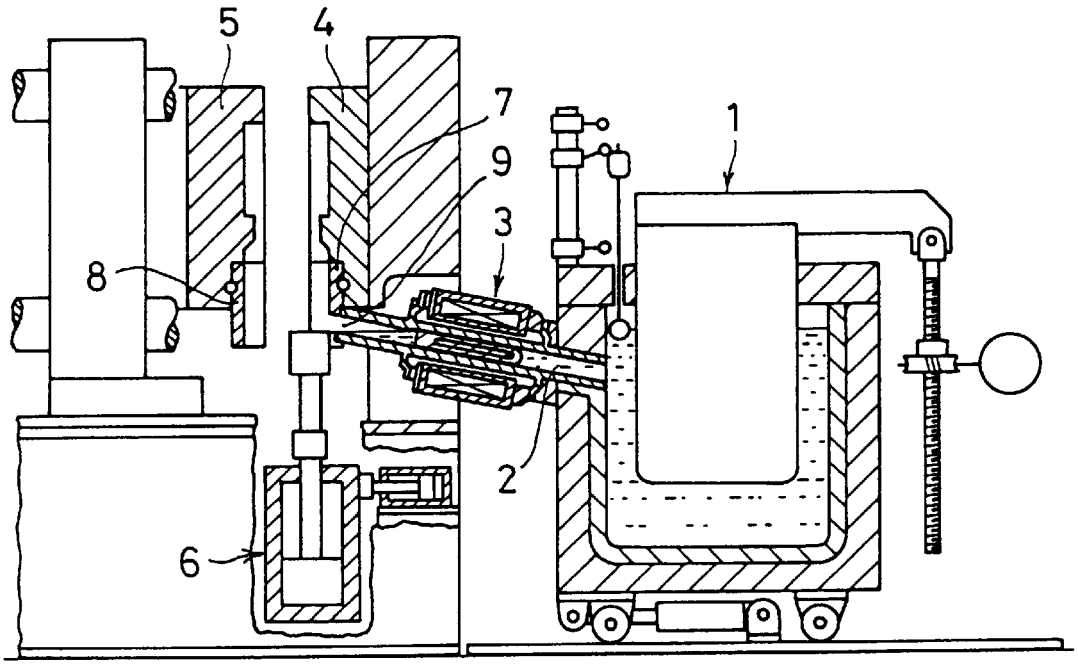
PRIOR ART FIG. 7A
FIGS. 7A and 7B are vertical sectional views of a conventional device.
Figure 7B:
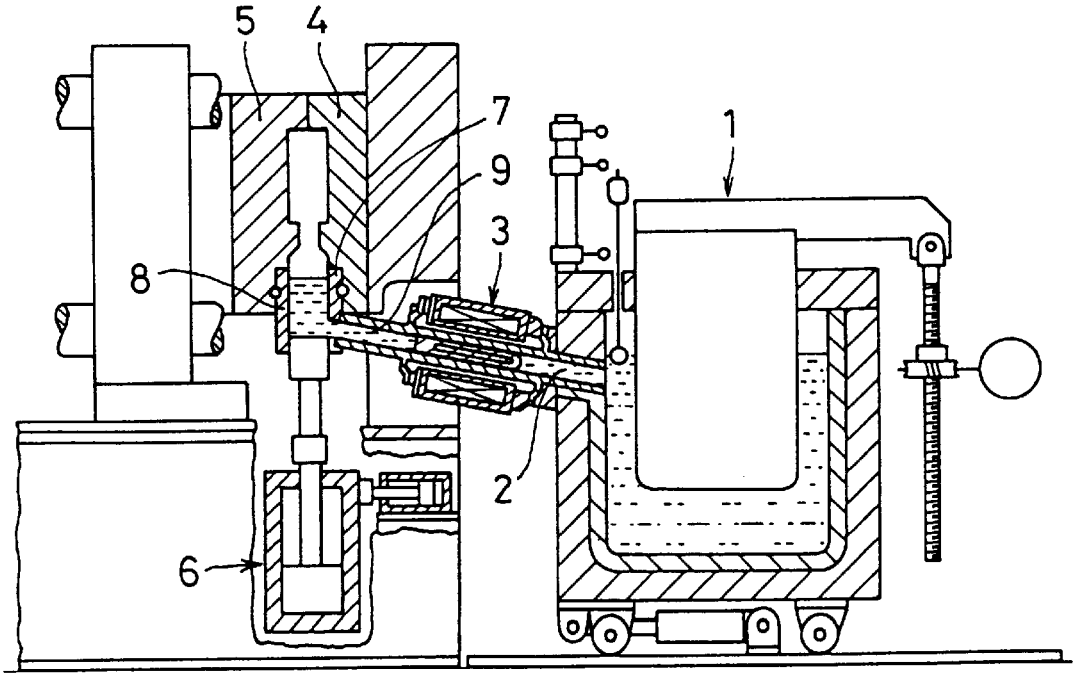
PRIOR ART FIG. 7B
Figure 9A:
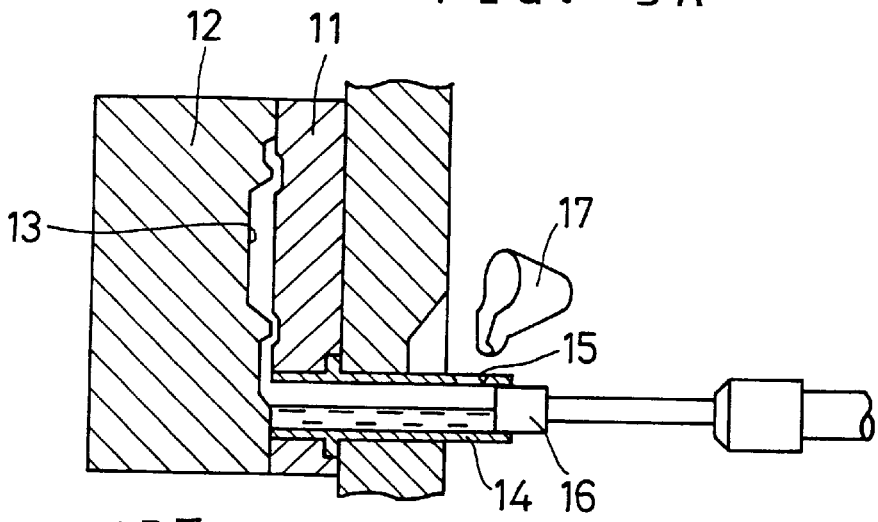
PRIOR ART FIG. 9A
FIGS. 9A to 9C are similar views of another conventional device.
Figure 9B:
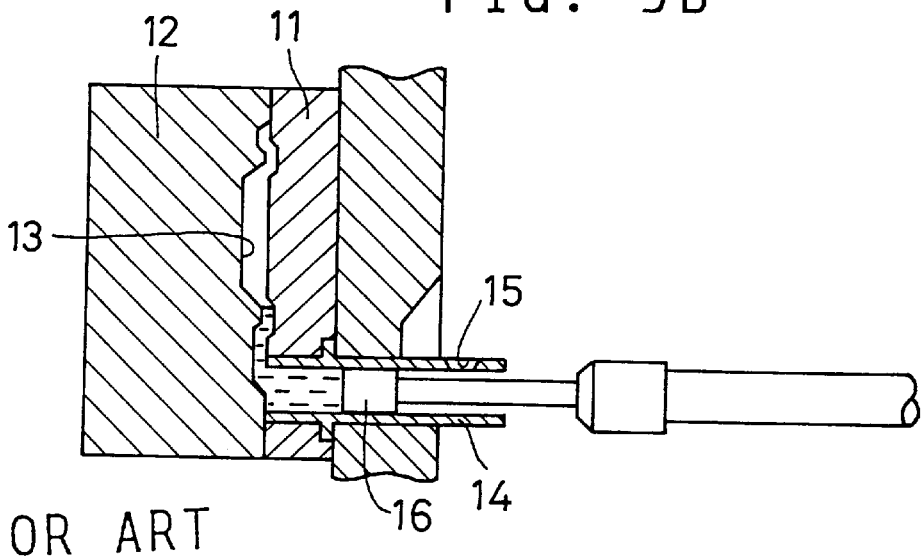
PRIOR ART FIG. 9B
Figure 9C:
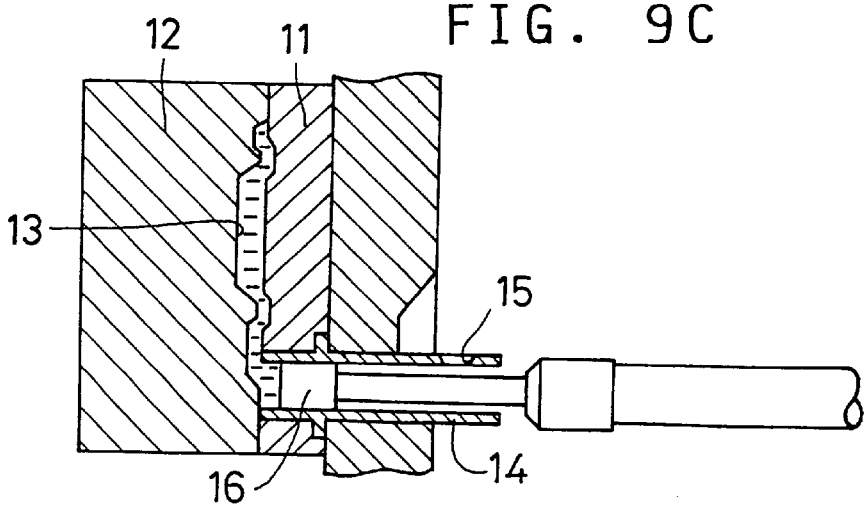
PRIOR ART FIG. 9C

FIG. 6 shows a state when the molds 22, 23 have been opened. The movable mold 23 is moved to its open position. At the same time, the second piston 41 is moved to its foremost position to extrude the biscuit portion B of the product A with its tip, thereby moving the product A together with the movable mold 23. At the same time, the sleeve 29 is rotated until the suction port 38 communicates with the passage 27 to prepare for the next supply of molten metal. That is, the positions of the members change through the state of FIG. 1 to that of FIG. 2.

According to this invention, the first and second pistons are axially movably mounted in the sleeve which rotates to open and close communication between the molten metal passage of the body and the suction port. The first piston sucks a predetermined amount of molten metal into the sleeve through the suction port and extrudes the thus sucked molten metal through the discharge port. The second piston opens and closes the discharge port and pressurizes molten metal discharged through the discharge port. The first and second pistons can be moved independently of each other, so that it is possible to prevent the development of an air layer in the passage for guiding molten metal from the material melting portion to the molds. This in turn makes it possible to prevent entry of air into molten metal being poured into the cavity, and thus prevent explosion and the development of pores in castings. Further, preparation for the supply of molten metal can be made irrespective of whether the molds are open or closed, so that it is possible to shorten the casting cycle.

What is claimed is:

1. An automatic molten metal supply and injection device comprising:

a body having a molten metal passage for guiding molten metal;

a sleeve having a suction port and a discharge port, said sleeve being mounted rotatably relative to said body between a communication position in which said suction port of said sleeve communicates with said molten metal passage of said body, and a closed position in which communication between said suction port of said sleeve and said molten metal passage of said body is blocked;

a first piston axially movably mounted in said sleeve for sucking molten metal into said sleeve through said suction port, and for extruding molten metal from within said sleeve through said discharge port of said sleeve; and a second piston, axially movably mounted in said first piston for movement relative thereto and relative to said discharge port, for movement in an extending direction through said discharge port for closing said discharge port and for pressurizing the molten metal through said discharge port, and for movement in a retracting direction;

wherein said first and second pistons are movable independently of each other.

2. The device claimed in claim 1, wherein while said suction port of said sleeve is communicating with said molten metal passage of said body, said discharge port is closed by said second piston, and when a predetermined amount of molten metal has been sucked into said sleeve by the movement of said first piston and said sleeve is rotated to said closed position, said second piston opens said discharge port, and said first piston extrudes the molten metal in said sleeve through said discharge port, and thereafter, said second piston pressurizes and extrudes molten metal through said discharge port, and said discharge port is closed.

3. The device claimed in claim 1, wherein said sleeve and said first and second pistons are arranged coaxially along a common axis.

4. The device claimed in claim 1, wherein said first piston has an axial through hole therein, and said second piston is axially movably mounted in said axial through hole.

5. The device claimed in claim 1, wherein said body has a circular hole formed therein, and said sleeve is rotatably mounted in said circular hole.

6. The device claimed in claim 5, wherein said first piston has an axial through hole therein, and said second piston is axially movably mounted in said axial through hole.

* * * * *